US009858883B2

(12) United States Patent
Jeong

(10) Patent No.: US 9,858,883 B2
(45) Date of Patent: Jan. 2, 2018

(54) DISPLAY DRIVER IC FOR DRIVING WITH HIGH SPEED AND CONTROLLING METHOD THEREOF

(71) Applicant: SAMSUNG ELECTRONICS CO., LTD., Suwon-si, Gyeonggi-do (KR)

(72) Inventor: Ji-Yong Jeong, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 119 days.

(21) Appl. No.: 14/733,230

(22) Filed: Jun. 8, 2015

(65) Prior Publication Data

US 2016/0012765 A1 Jan. 14, 2016

(30) Foreign Application Priority Data

Jul. 14, 2014 (KR) ..... 10-2014-0088505

(51) Int. Cl.
*G09G 3/36* (2006.01)

(52) U.S. Cl.
CPC ... *G09G 3/3685* (2013.01); *G09G 2310/0248* (2013.01); *G09G 2310/0289* (2013.01); *G09G 2320/0252* (2013.01)

(58) Field of Classification Search
CPC .. G09G 3/30; G09G 3/32; G09G 3/34; G09G 3/36; G09G 5/00; G09G 5/10; G06F 3/038
See application file for complete search history.

(56) References Cited

U.S. PATENT DOCUMENTS

| | | | | |
|---|---|---|---|---|
| 7,990,351 | B2 | 8/2011 | Lew et al. | |
| 8,519,926 | B2 * | 8/2013 | Lim | G09G 3/3688 345/100 |
| 2003/0085865 | A1 * | 5/2003 | Lee | G09G 3/3688 345/98 |
| 2006/0238477 | A1 * | 10/2006 | Lew | G09G 3/3688 345/94 |
| 2007/0040855 | A1 * | 2/2007 | Kato | G09G 3/3688 345/690 |
| 2009/0051676 | A1 * | 2/2009 | Cho | G09G 3/20 345/211 |

(Continued)

FOREIGN PATENT DOCUMENTS

| | | | |
|---|---|---|---|
| KR | 10-2006-0112328 | A | 11/2006 |
| KR | 10-2008-0001850 | A | 1/2008 |
| KR | 10-2008-0107064 | A | 12/2008 |

OTHER PUBLICATIONS

Young-Suk Son et al., A Gray-Level Dependent Pre-Emphasis Column Driver, etc. IEEE Transactions on Circuits and Systems—II: Express Briefs, vol. 54, No. 12, Dec. 2007.

(Continued)

*Primary Examiner* — Pegeman Karimi
(74) *Attorney, Agent, or Firm* — Lee & Morse, P.C.

(57) ABSTRACT

A display apparatus includes a source driver printed circuit board (PCB) to provide a control signal, a panel to receive the control signal for controlling display of an image, a connector between the source driver PCB and the panel, and a source driver integrated circuit (IC) attached to the connector. The source driver IC provides a pixel voltage which corresponds to an output signal. The pixel voltage is output during a first predetermined time and is different from a data voltage corresponding to an input signal.

18 Claims, 10 Drawing Sheets

(56) References Cited

U.S. PATENT DOCUMENTS

| | | | | |
|---|---|---|---|---|
| 2011/0050749 | A1* | 3/2011 | Park | G09G 3/20 345/690 |
| 2012/0042287 | A1 | 2/2012 | Saito et al. | |
| 2012/0044984 | A1 | 2/2012 | Zerbe et al. | |
| 2012/0098813 | A1* | 4/2012 | Park | G09G 3/3611 345/211 |

OTHER PUBLICATIONS

Yoo-Chang Sung et al., Low-Cost TFT-LCDs with Pre-emphasis Driving Method, etc. IEEE Transactions on Consumer Electronics, vol. 53, No. 4, Nov. 2007.

* cited by examiner

| | N+n line Data | (N+1)+n line Data |
|---|---|---|
| $V_{IN}$ | V1 | V1 |
| $V_{C1}$ | 0 | 0 |
| $V_{C2}$ | V1 | V2 |
| $V_{OUT}$ | V1 | V2 |

| | N+n line Data |
|---|---|
| $V_{IN}$ | V2 |
| $V_{C1}$ | (V2-V1)* α ( α =C2/C1) |
| $V_{C2}$ | V2 |
| $V_{OUT}$ | V2+VC1 |

DISPLAY DRIVER IC FOR DRIVING WITH HIGH SPEED AND CONTROLLING METHOD THEREOF

CROSS-REFERENCE TO RELATED APPLICATION

Korean Patent Application No. 10-2014-0088505, filed on Jul. 14, 2014, and entitled, "Display Driver IC for Driving with High Speed and Controlling Method Thereof," is incorporated by reference herein in its entirety.

BACKGROUND

1. Field

One or more embodiments described herein relate to a display driver integrated circuit (IC) for performing high-speed driving and a method for controlling a display driver IC.

2. Description of the Related Art

One type of display driver IC (DDI) is used to drive a liquid crystal display (LCD). An LCD generates images using a liquid crystal layer between two substrates. In operation, the transmittance of light passing through the liquid crystal layer is adjusted according to an applied image signal, and images are formed as a result. The operational speeds of DDIs may need to be increased as the resolution and display area of the LCDs increase.

SUMMARY

In accordance with one embodiment, a display apparatus including a source driver printed circuit board (PCB) to provide a control signal; a panel to receive the control signal for controlling display of an image; a connector between the source driver PCB and the panel; and a source driver integrated circuit (IC) attached to the connector, wherein the source driver IC provides a pixel voltage which corresponds to an output signal, and wherein the pixel voltage is output during a first predetermined time and is different from a data voltage corresponding to an input signal.

The source driver IC may apply a pre-emphasis voltage to the output signal during a second predetermined time, and control a slew rate of the output signal. The source driver IC may include a serial-to-parallel data converter to convert digital image data in a serial form to a parallel form; a data latch to latch the digital image data in the parallel form; a digital-to-analog (DA) converter to convert the latched digital image data to analog image data; and an output buffer provide the received analog image data to the panel.

The output buffer may include an operational amplifier having a first input terminal to receive an input signal and a second input terminal to receive a feedback signal; a switch connected between the second input terminal of the operational amplifier and an output terminal of the operational amplifier; a first capacitor connected between the second input terminal of the operational amplifier and the output terminal of the operational amplifier, the first capacitor connected in parallel with the switch; and a second capacitor between the second input terminal of the operational amplifier and a reference voltage. The source driver IC may control the pre-emphasis voltage based on an on state or off state of the switch.

The source driver IC may generate the pre-emphasis voltage when the switch is in an off state. The source driver IC may generate the pre-emphasis voltage to have a magnitude based on a capacitance distribution ratio of the first and second capacitors. The source driver IC may adjust a slew rate of the output signal when the pre-emphasis voltage is generated.

When hen the pre-emphasis voltage is applied, an output characteristic of the output signal has a greater slope than an input signal of the operational amplifier. A point corresponding to a predetermined percentage in a rising range of the output signal may be higher than a level of a point corresponding to a predetermined percentage in a rising range of the input signal. The predetermined percentage may be about 67%.

In accordance with another embodiment, a method for controlling a display driver integrated circuit includes applying a first input voltage to a pixel of an $n^{th}$ line; applying a second input voltage to a pixel of an $(n+1)^{th}$ line; generating a pre-emphasis voltage relative to the pixel of the $(n+1)^{th}$ line; and additionally applying the pre-emphasis voltage to the second input voltage of the pixel of the $(n+1)^{th}$ line. Applying the pre-emphasis voltage of the pixel of the $(n+1)^{th}$ line is performed in two phases.

The display driver IC may include an output buffer, the output buffer may include an operational amplifier having a switch, and the switch connected to the operational amplifier may be turned on when the first input voltage and the second input voltage are applied to the pixels of the $n^{th}$ line and the pixel of the $(n+1)^{th}$ line, respectively.

Generating the pre-emphasis voltage may include turning off the switch connected to the operational amplifier. The switch connected to the operational amplifier may be connected to a feedback terminal side of the operational amplifier. The method may include, when the pre-emphasis voltage is applied, controlling a characteristic of an output voltage of the operational amplifier to have a greater slope than the input second input voltage.

In accordance with another embodiment, An apparatus includes an input; an output; and a driver including the input and output, wherein the driver is to provide a pixel voltage corresponding to an output signal, the pixel voltage different from a data voltage corresponding to an input signal, and wherein the driver is to adjust a slew rate of the output voltage relative to the input signal, the slew rate adjusted to reduce a delay of a signal line connected to a display panel. The source driver may be coupled to a connector attached to the display panel. The delay may be an RC time constant of the signal line. The signal line may be a data line.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
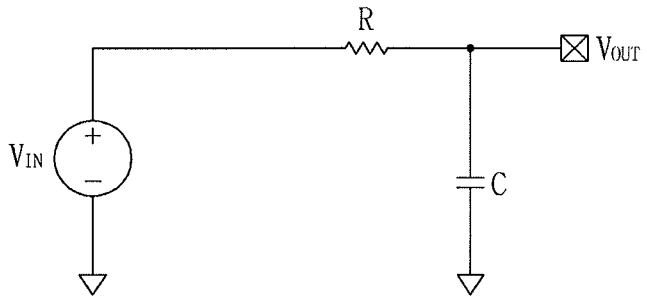
FIG. 1 illustrates a source driver IC.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion, that is, "between" versus "directly between," adjacent" versus "directly adjacent," etc.

FIG. 1 illustrates a source driver IC. The source driver IC may be connected to a data line of a pixel, may provide image data (R, G, and B) to the pixel, and may therefore control full-color display of images. Referring to FIG. 1, the source driver IC may receive an input signal $V_{IN}$ and provide an output signal $V_{OUT}$. In operation, line resistance R and capacitance C may occur for a data line between the input signal $V_{IN}$ and the output signal $V_{OUT}$.

For example, as the resolution and size of an LCD increase, widths of the data lines and a gate lines may be reduced and their lengths may increase. As a result, parasitic capacitance may increase, and the driving voltage of each pixel may be distorted and transferred. Under some conditions, when a data voltage is applied to the pixel, the data voltage may be distorted by a resistor-capacitor (RC) delay. The degree of this distortion may increase for pixels that are located farther away from a signal wire. As a result, a fill factor of these more-distant pixels may be reduced. Consequently, the actual pixel voltage may deviate from the applied data voltage.

Figure 2:
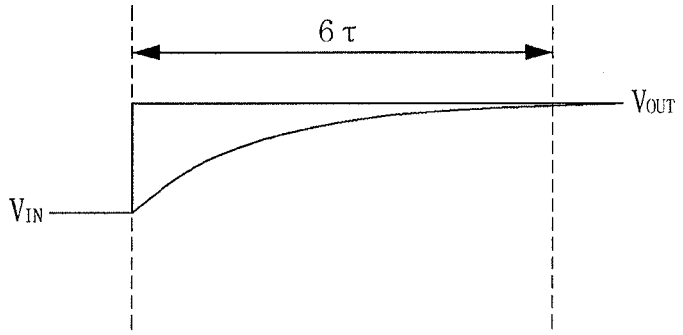
FIG. 2 illustrates an output signal $V_{OUT}$ generated based on an input signal $V_{IN}$.

FIG. 2 is a graph illustrating one type of characteristic of the output signal $V_{OUT}$ generated based on the input signal $V_{IN}$. Referring to FIG. 2, when the input signal $V_{IN}$ of the source driver IC is applied (e.g., when the data voltage is applied, as opposed to the output signal $V_{OUT}$, which is the voltage that actually appears on the pixel), a long time may be required to reach the data voltage which is the input signal $V_{IN}$.

This is due to the RC time constant of the resistor and capacitor described in FIG. 1. Thus, the driving of the line may be delayed based on the RC time constant. A voltage at a point of approximately 67% of the target voltage may be defined, for example, as the RC time constant.

As described above, because a frame rate or frame frequency, and the number of driving lines, increases for higher resolutions and sizes of the panel, faster driving speeds may be required. However, it is difficult to ignore influences of parasitic resistance and parasitic capacitance gate lines of long length. Therefore, techniques in which the output signal $V_{OUT}$ is provided by applying a pre-emphasis voltage may be applied.

Figure 3A:
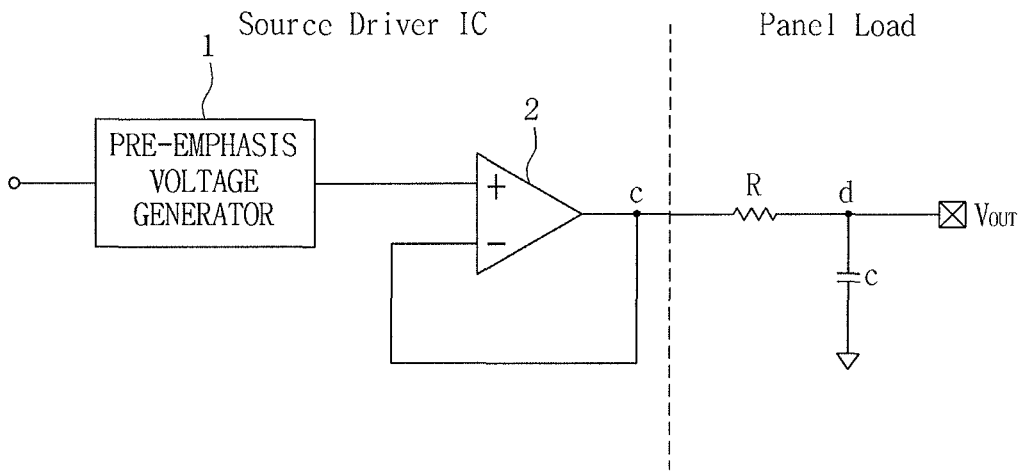
FIG. 3A illustrates a source driver IC and a panel.

FIG. 3A is an equivalent circuit diagram illustrating one type of relationship that may exist between the source driver IC and panel. Referring to FIG. 3A, the source driver IC includes a pre-emphasis voltage generator 1 and an operational amplifier 2. The operational amplifier 2 receives a voltage from the pre-emphasis voltage generator 1. Therefore, the operational amplifier 2 may receive a pre-emphasis voltage as an input signal $V_{IN}$ and then may provide the output signal $V_{OUT}$.

Figure 3B:
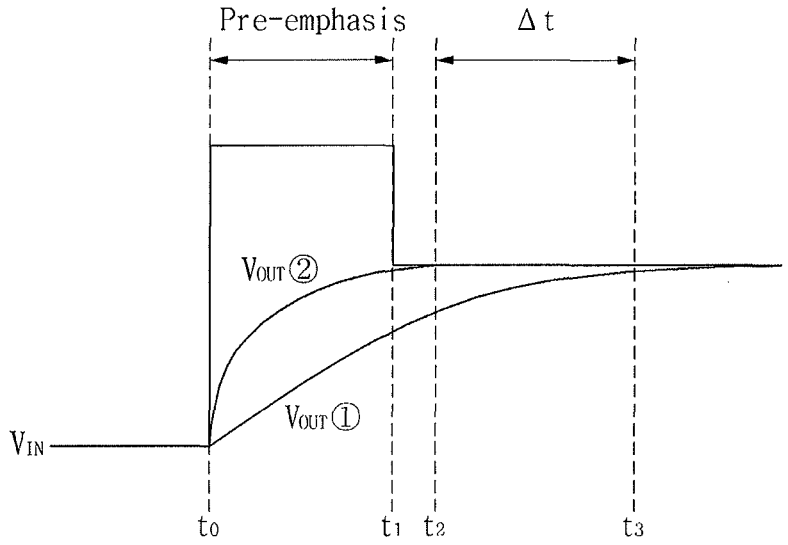
FIG. 3B illustrates an output signal $V_{OUT}$ generated when a pre-emphasis voltage is applied to an input signal $V_{IN}$ terminal.

FIG. 3B is a graph showing an example of a characteristic of the output signal $V_{OUT}$ when the pre-emphasis voltage is applied to input signal $V_{IN}$ terminal. Referring to FIG. 3B, the pre-emphasis voltage may be applied in time intervals of t0 to t1. For example, a voltage which is greater than an input voltage by a predetermined voltage may be applied during a predetermined time. Therefore, the output signal $V_{OUT②}$ of a desired voltage value may be provided at time t2.

In comparison with time t3, at which the desired voltage is output when the pre-emphasis technique is not applied (an output signal $V_{OUT①}$), the desired voltage is determined to be output at an earlier time t2 when the pre-emphasis technique is applied. This is because the RC time constant is improved by the pre-emphasis voltage. Thus, an output time may be reduced by Δt, and the driving time of a pixel may be faster as a result.

Pre-emphasis voltage application techniques may therefore reduce delay time for the output voltage reaching the target voltage due to RC delay. However, pre-emphasis techniques requires the use of a plurality of capacitors and switches, and control operation based on various on/off combinations of the switches. Therefore, these switches require many switch control signals, which increase the overall complexity and cost of the circuit. Furthermore, an additional operational amplifying operating time may be needed due to an additional capacitor added to the input terminal of the operational amplifier 2.

Alternatively, when a pre-emphasis voltage that is already computed is directly applied to the input terminal of the source driver IC, an operational memory may be required along with one or more additional operations. This may also increase circuit complexity and may cause additional circuit driving problems to occur.

In with one or more embodiments, a technique is provided which increases driving speed while using a control circuit with reduced complexity.

Figure 4:
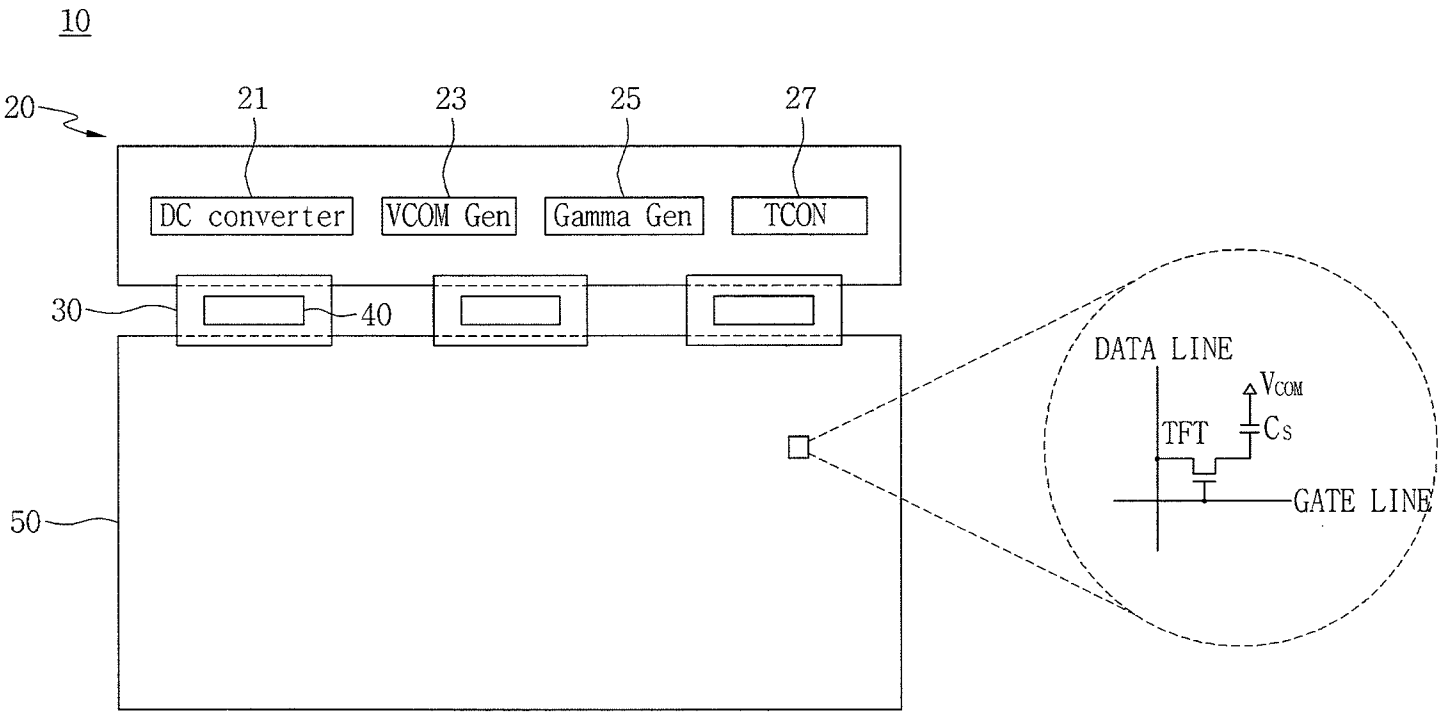
FIG. 4 illustrates an embodiment of a display apparatus.

FIG. 4 illustrates an embodiment of a display apparatus 10 which includes one or more source driver ICs 40. Referring to FIG. 4, the display apparatus 10 includes a source driver printed circuit board (PCB) 20, an interface (e.g., connecting members) 30, source driver ICs 40, and a panel 50.

The source driver PCB 20 includes a direct current (DC) converter 21, a common voltage generator (VCOM Gen) 23, a gamma voltage generator (Gamma Gen) 25, and a timing controller (TCON) 27. The source driver PCB 20 may provide a control signal for display.

The DC converter 21 receives an external voltage and performs a conversion to an internal voltage for an operation. For example, when an external voltage of 5 V is applied, it may be increased and provided to a voltage of 18 V, which is the internal voltage for the operation in the DC converter 21.

The VCOM Gen 23 generates a common voltage $V_{COM}$ applied to a unit pixel in the panel 50.

The Gamma Gen 25 may include a plurality of resistor rows between a power voltage and a ground voltage, and may provide voltages, which are distributed by each node, as gamma voltages. The gamma voltage may be a voltage for converting digital image data (R, G, and B) into analog image data signals. Thus, the gamma voltages may include positive gamma voltages having a positive polarity and/or negative gamma voltages having negative polarity.

The TCON 27 may provide various control signals for controlling operation of the panel 50. For example, the TCON 27 may provide a gate control signal using a vertical/horizontal synchronization signal and a clock signal, and may provide digital image data signals (R, G, and B), formed by converting image signals received from the outside and a data control signal, to the source driver IC 40.

The connecting members 30 serve as interfaces between the source driver PCB 20 and the panel 50, to connect the source driver PCB 20 to the panel 50. The connecting members 30 may be, for example, film-type connectors.

Each of the source driver ICs includes one or more input terminals and one or more output terminals. In accordance with the present embodiment, the source driver ICs 40 are attached to respective ones of the connecting members 30. The source driver ICs 40 are provided to adjust a slew rate of an output signal with respect to an input signal, when the data voltage is applied to the unit pixel of the panel 50. For example, a switch and a capacitor are applied to an output terminal of each of the source driver ICs 40 and are appropriately controlled. Thus, a limit of the RC time constant may be reduced or eliminated.

The panel 50 may receive control signals and display images based on the control signals. The panel 50 includes a plurality of unit pixels arranged in a matrix. The unit pixels are located at respective intersections of gate lines and data lines. FIG. 4 shows one unit pixel for illustrative purposes.

The panel 50 includes a switching device thin film transistor (TFT) connected to the gate line and the data line, and a liquid crystal capacitor $C_S$ connected to the switching device TFT. The liquid crystal capacitor $C_S$ has two terminals (namely, a drain terminal of the switching device TFT and common voltage $V_{COM}$). A dielectric layer having dielectric anisotropy is located between the two terminals.

In operation, a data voltage is transferred from the data line connected to a corresponding one of the source driver ICs 40 to the drain terminal of the switching device TFT of the unit pixel. As a result, the liquid crystal orientation state of a corresponding liquid crystal cell is changed by an electric field applied to the liquid crystal capacitor $C_S$. Light of an image is then displayed.

As described above, in such an LCD device, the number of data lines being driven increases as the size of the panel increases. Thus, a predetermined time may be increased until the data voltage applied to the source driver IC 40 is transferred to the unit pixel. Accordingly, the operational speed of the panel 50 may be adversely affected, and in a severe case distortion of the voltage may occur.

In one embodiment, the switch and capacitor connected to the output terminal of the source driver IC 40 are controlled. Thus, transfer speed of the data voltage increases, an output speed of the output signal may be improved. For example, the source driver IC 40 may control a voltage magnitude of the output signal to be different from that of the input signal during a predetermined time. Thus, an output voltage characteristic of the output signal is improved, and the RC time constant of the output voltage may be improved.

Figure 5:
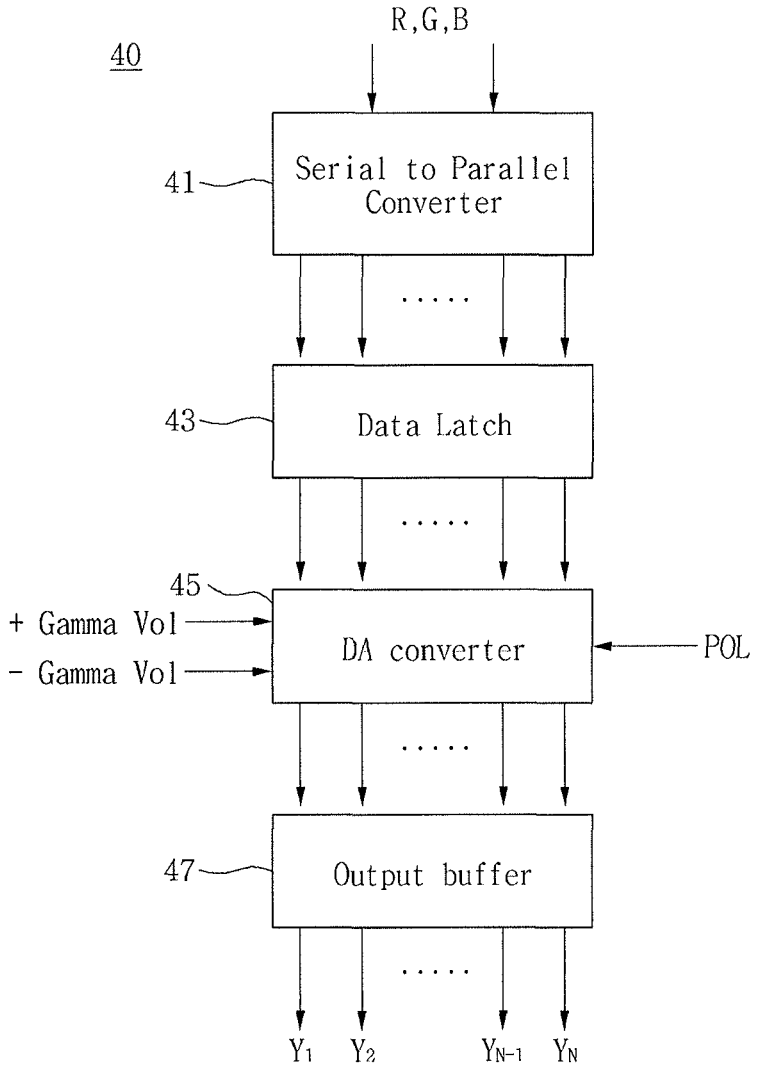
FIG. 5 illustrates an embodiment of a source driver IC.

FIG. 5 illustrates an embodiment of a source driver IC, which, for example, may be the source driver IC 40 in FIG. 4. Referring to FIG. 5, the source driver IC 40 includes a serial-to-parallel converter 41, a data latch 43, a DA converter 45, and an output buffer 47. The source driver IC 40 may be a display driver integrated circuit (DDI).

The serial-to-parallel converter 41 may convert digital image data (R, G, and B) in a serial form to digital image data in a parallel form. Thus, the serial-to-parallel converter 41 provides the digital image data in a parallel form to the data latch 43. The data latch 43 latches the received digital image data in a parallel form.

The DA converter 45 converts the latched digital image data to analog image data. The DA converter 45 converts the latched digital image data to the analog image data corresponding to the gamma voltage input using the positive gamma voltage+Gamma Vol, the negative gamma voltage−Gamma Vol, and a polarity control signal POL, as described in FIG. 4. For example, the DA converter 45 may perform D/A converting of the image data using a total of 18 gamma voltages: 9 positive gamma voltages+Gamma Vol and 9 negative gamma voltages−Gamma Vol.

The output buffer 47 may supply the received analog image data to the data line of the panel 50 (see FIG. 4). For example, in accordance with one embodiment, the output buffer 47 is provided to increase the data voltage (which is the analog image data signal) by a predetermined value during a predetermined time. Thus, the output speed and a voltage characteristic of the output signal may be improved.

Figure 6:
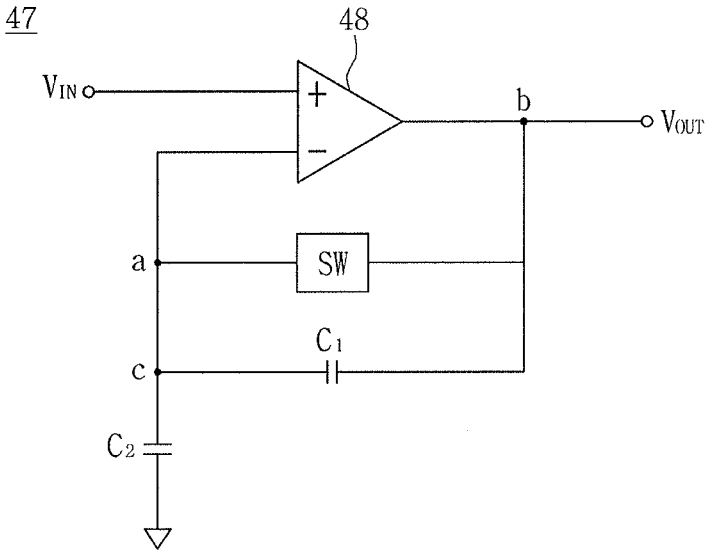
FIG. 6 illustrates an embodiment of an output buffer.

FIG. 6 is an equivalent circuit diagram of one embodiment of an output buffer, which, for example, may be output buffer 47 in FIG. 5. Referring to FIG. 6, the output buffer 47 includes an operational amplifier 48, a switch SW, a first capacitor $C_1$, and a second capacitor $C_2$.

The operational amplifier 48 receives an input signal $V_{IN}$ from a non-inverting terminal and a feedback signal from an inverting terminal. If the voltages of the two input terminals are substantially the same, no current flows into the operational amplifier 48. The operational amplifier 48 provides the output signal $V_{OUT}$ through a node b.

The switch SW is provided between a node a and the node b. For example, the turn-on/turn-off state of the switch SW is controlled, and thus an output voltage of the operational amplifier 48 may increase by a predetermined value. The increased voltage may improve the output speed of the output signal $V_{OUT}$, e.g., an output characteristic. As a result, RC delay may be improved.

A first capacitor $C_1$ is provided between a node c and the node b, and a second capacitor $C_2$ is provided between the node c and a ground voltage GND. The first capacitor $C_1$, similar to the switch SW, is connected between the inverting terminal and the output terminal of the operational amplifier 48, and is formed in parallel with the switch SW.

According to one embodiment, a voltage may be controlled at the output terminal side rather than the input terminal side or the feedback terminal side. Thus, the operational amplifying operational speed of the operational amplifier 48 may not be limited.

Figure 7A:
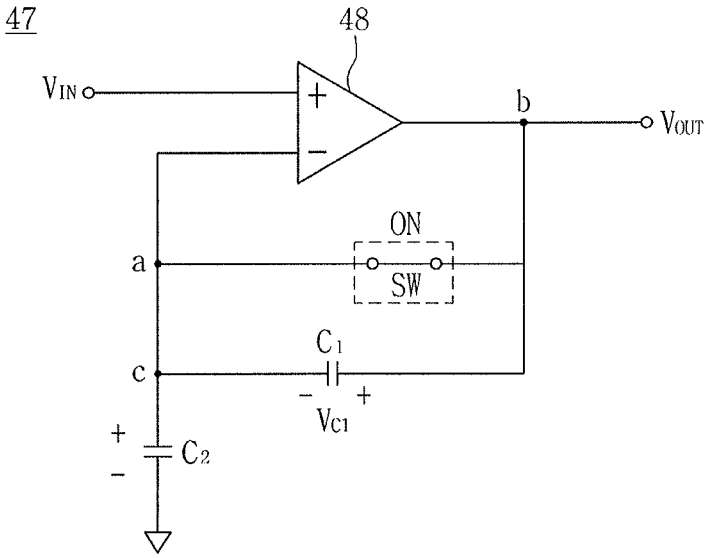
FIG. 7A illustrates an example of the output buffer when a switch is turned on, and FIG. 7B illustrates examples of operational states according to FIG. 7A.
Figures 7B, 8A:
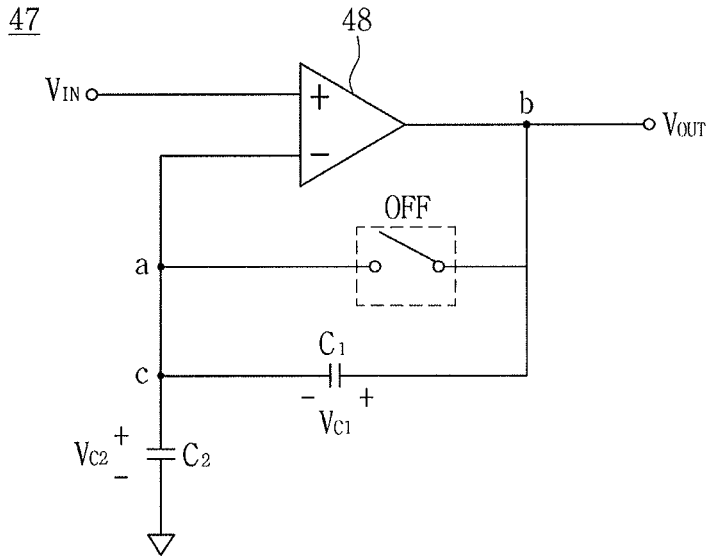
FIG. 8A illustrates an example of the output buffer when the switch is turned off.

A structure and operation of the output buffer 47 in accordance with one embodiment is described with reference to FIGS. 7A to 8B. First, FIG. 7A shows the output buffer 47 in a state in which the switch turns on, e.g., a normal operation state. FIG. 7B is a table showing examples of operational states for the output buffer 47 in FIG. 7A.

A case in which a first input voltage V1 is applied to the non-inverting terminal of the operational amplifier 48 will be described with reference to FIGS. 7A and 7B. For example, the same voltage may be applied to inverting terminal of the operational amplifier 48 (when the first input voltage V1 is applied to a pixel of an $n^{th}$ line, the first input voltage V1 may also be applied to the inverting terminal). When this occurs, the output voltage also becomes V1. As a result, the voltages applied to both terminals of the first capacitor $C_1$ (e.g., voltages of nodes c and b) are the same. Thus, no charge is charged in the first capacitor $C_1$.

The second capacitor $C_2$ may be charged by an amount of charge equal to a voltage difference between the voltage of the node c and a ground voltage GND. The voltage applied to the second capacitor $C_2$ may become V1 which is the voltage difference between the voltage of the node c and the ground voltage GND.

A case in which a second input voltage V2 is applied to a pixel of an $(n+1)^{th}$ line and the switch SW is turned on will now be described.

The second input voltage V2 is applied to the non-inverting terminal of the operational amplifier 48, and the same voltage V2 is also applied to the inverting terminal of the operational amplifier 48. Thus, the output voltage also becomes V2. At this time, the voltages applied to both terminals of the first capacitor $C_1$ (e.g., voltages of the node c and the node b) are the same, V2. Thus, no charge is charged in the first capacitor $C_1$.

The second capacitor $C_2$ may be charged by an amount of charge equal to a voltage difference between the voltage of the node c and the ground voltage GND. The voltage applied to the second capacitor $C_2$ may become V2. This is reflected in the table of FIG. 7B.

Figures 8B, 9:
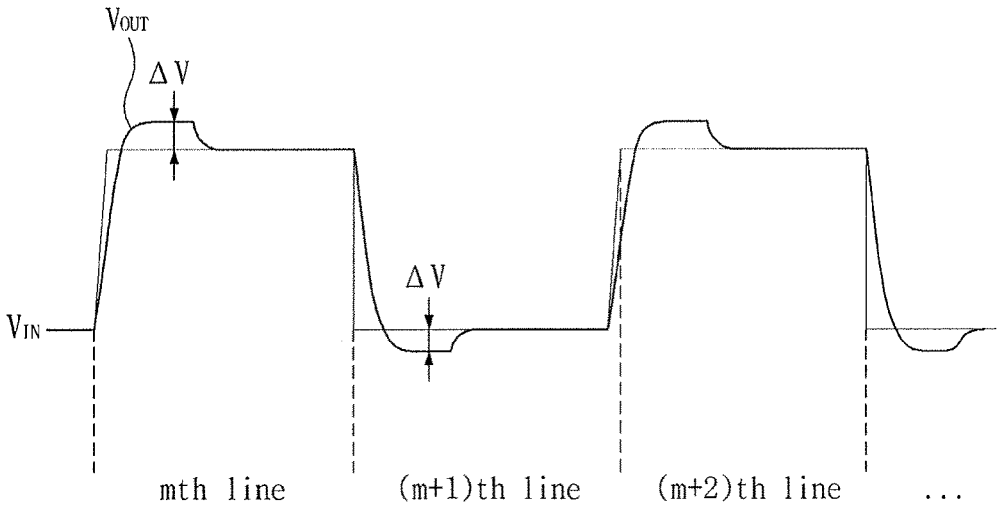
FIG. 8B illustrates an example of operational states according to FIG. 8A.
FIG. 9 illustrates an example of operation of the output buffer.

FIGS. 8A and 8B respectively illustrate an embodiment of an equivalent circuit and a table showing when the pre-emphasis voltage may be applied to the pixel of the $(n+1)^{th}$ line. Applying of the pre-emphasis voltage will be described with reference to FIGS. 8A and 8B. For example, a case in which the pre-emphasis voltage is applied to the pixel of the $(n+1)^{th}$ line will be described.

Referring to FIG. 8A, the switch SW connected to the inverting terminal turns off. Because the input voltage of the non-inverting terminal of the operational amplifier 48 is V2, the voltage of the node c becomes V2. Therefore, the voltages applied to both terminals of the second capacitor $C_2$ are also V2.

Further, because the switch SW is turned off, the voltage of the output node b may provided in an amount greater than V2, by adding by a voltage applied to the first capacitor $C_1$. Since the switch SW is turned off and no current flows into the operational amplifier 48, current which flows from the node a to paths of the first and second capacitors $C_1$ and $C_2$ may be substantially the same.

This may be understood, for example, based on Equations 1 and 2.

$$C_1 * V_{C1} = C_2 * V_{C2} \quad (1)$$

$$V_{C1} = (C2/C1) * V_{C2} \quad (2)$$

In Equations (1) and (2), $C_1$ is the capacitance of the first capacitor, $C_2$ is the capacitance of the second capacitor, $V_{C1}$ is a voltage difference between the terminals of the first capacitor, and $V_{C2}$ is a voltage difference between the terminals of the second capacitor.

As shown in Equation 1, the capacitance of the first capacitor $C_1$ may be represented as a distribution ratio of the capacitance of the first and second capacitors $C_1$ and $C_2$. For example, the magnitude of the voltage to be increased may be determined by the distribution ratio of the capacitance of the first and second capacitors $C_1$ and $C_2$.

When the switch SW is turned off, the voltage difference between the terminals of the second capacitor $C_2$ is changed from a previous state. $V_{C2}$ may be based on Equation 3:

$$V_{C2} = (V2 - V1) \quad (3)$$

where V2 is the current input voltage and V1 is the previous input voltage.

Therefore, the voltage difference between the terminals of the first capacitor $C_1$ in a state in which the switch SW is turned off may be represented as follows by manipulation of Equations 1, 2, and 3, resulting in Equation 4.

$$V_{C1} = (C2/C1) * (V2 - V1) \quad (4)$$

Therefore, the voltage of the output node b, while the switch SW is turned off, may be provided as a voltage in which the pre-emphasis voltage is added to the V2 voltage at the time when the V2 voltage is applied, e.g., a voltage increased by adding $V_{C1}$ to V2 (see Equation 5).

$$V_{OUT} = V2 + V_{C1} \quad (5)$$

State and voltage changes may be tabulated as in the table of FIG. 8B.

Thus, in the present embodiment, an increased voltage in the form of the pre-emphasis voltage may be provided as the switch SW is appropriately adjusted between the output node and the inverting node (or the feedback terminal) of the operational amplifier 48. Because only one switch SW is provided, the design and configuration of the circuit may be simplified.

Also, because only one switch SW is adjusted, the control operation to be performed is simplified. Furthermore, because control may be performed in two-steps or in two-phases for applying the pre-emphasis voltage to an $(n+1)^{th}$ pixel, the control operation to be performed is simplified.

Based on the $(n+1)^{th}$ pixel, a pre-emphasis voltage applying operation may be completed in a normal operational phase and a pre-emphasis operational phase, e.g., in two-phases. As described above, after a data signal (e.g., a pixel voltage) is applied to the previous pixel, the corresponding pixel voltage is applied based on the $(n+1)^{th}$ pixel. Then, only the switch SW is turned off. Thus, a voltage increased by a predetermined value may be applied.

When the pixel voltage is applied to the previous pixel, the pre-emphasis voltage is applied to subsequent pixels. Thus, an output characteristic of the output signal $V_{OUT}$ may be improved. In addition, the increased voltage is applied to the input terminal by directly applying the increased voltage to the output node. Thus, the operational speed may be increased, e.g., because there is no waiting time for performing an operational amplify operation.

Further, because the increased voltage is adjusted based on the distribution ratio of the capacitance, and because an additional device related to the increased voltage application (e.g. an operational latch, a latch circuit, and the like) is not required, capacity and cost of the circuit may be improved.

Also, a signal which controls the pre-emphasis operation may be provided from the timing controller, and the pre-emphasis operation may be controlled based on the control signal.

FIG. 9 illustrates an embodiment of how the output buffer 47 in FIG. 6 may operate. In FIG. 9, a state in which a pre-emphasis voltage is applied to the output voltage $V_{OUT}$ is shown when the input voltage $V_{IN}$ is provided.

As described above, the magnitude of the pre-emphasis voltage may be determined based on a capacitance ratio of the in the output buffer 47. The pre-emphasis voltage ΔV is applied to an $m^{th}$ line. Thus, an output characteristic and the slew rate of the output voltage $V_{OUT}$ are improved.

In another embodiment, the pre-emphasis voltage ΔV is decreased in an $(m+1)^{th}$ line. Thus, a decreasing characteristic and the slew rate of the output voltage $V_{OUT}$ are improved. If the pre-emphasis voltage is applied by additionally charging the capacitor, decreasing the voltage may be performed by additionally discharging the capacitor.

The pre-emphasis voltage ΔV applied to an $(m+2)^{th}$ line may be the same as applied to the $m^{th}$ line. Thus, the output characteristic and the slew rate of the output voltage $V_{OUT}$ are improved.

To summarize with reference to FIG. 9, the output voltage characteristic of the output voltage $V_{OUT}$ may have a greater slope than a voltage characteristic of the input signal $V_{IN}$. Therefore, points of a predetermined percentage (e.g., 67%) of the target voltages, which, for example, may determine the RC time constant, may be controlled to be different between the input signal $V_{IN}$ and the output voltage $V_{OUT}$. Thus, because a limit factor of the RC delay may be reduced or eliminated by a simple operation of turn-on/turn-off of the switch SW, a display apparatus having high driving speed may be implemented.

Figure 10:
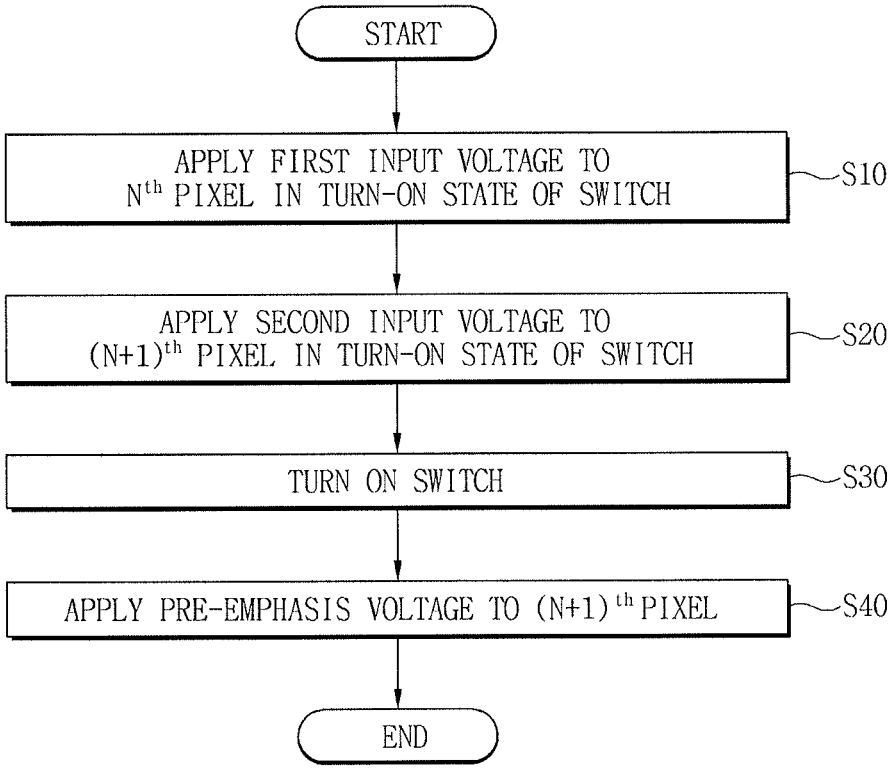
FIG. 10 illustrates an embodiment of a method for operational control of the output buffer.

FIG. 10 illustrates operations included in an embodiment of a method for performing operational control of the output buffer 47. This embodiment may be described with reference to FIGS. 6, 7A, 8A, and 10, where the first input voltage V1 is applied to the pixel of the $n^{th}$ line. At this time, the switch SW is in a turned-on state (S10). The second input voltage V2 is applied to the pixel of the $(n+1)^{th}$ line (S20). The switch SW of the output buffer 47 is still in a turned-on state. Normal operation therefore exists up to this point.

As the pre-emphasis voltage applying operation is performed by a control signal for the pre-emphasis voltage in the $(n+1)^{th}$ line, the switch SW of the output buffer 47 is turned off when data is applied to the pixel of the $(n+1)^{th}$ line (S30). At this time, because the switch SW is in a turned-off state, a voltage determined by the capacitance distribution ratio of the first and second capacitors $C_1$ and $C_2$ may be applied to the first capacitor $C_1$. Thus, the pre-emphasis voltage may be generated.

The pre-emphasis voltage may be additionally applied to the pixel of the $(n+1)^{th}$ line, and then the output voltage may be provided as an increased voltage (S40).

Thus, according to the present embodiment, as the voltage of the output node is increased or decreased by a predetermined value and the slew rate of the output voltage is improved, a limit of the RC delay for an upsized panel may be reduced or eliminated.

Figure 11:
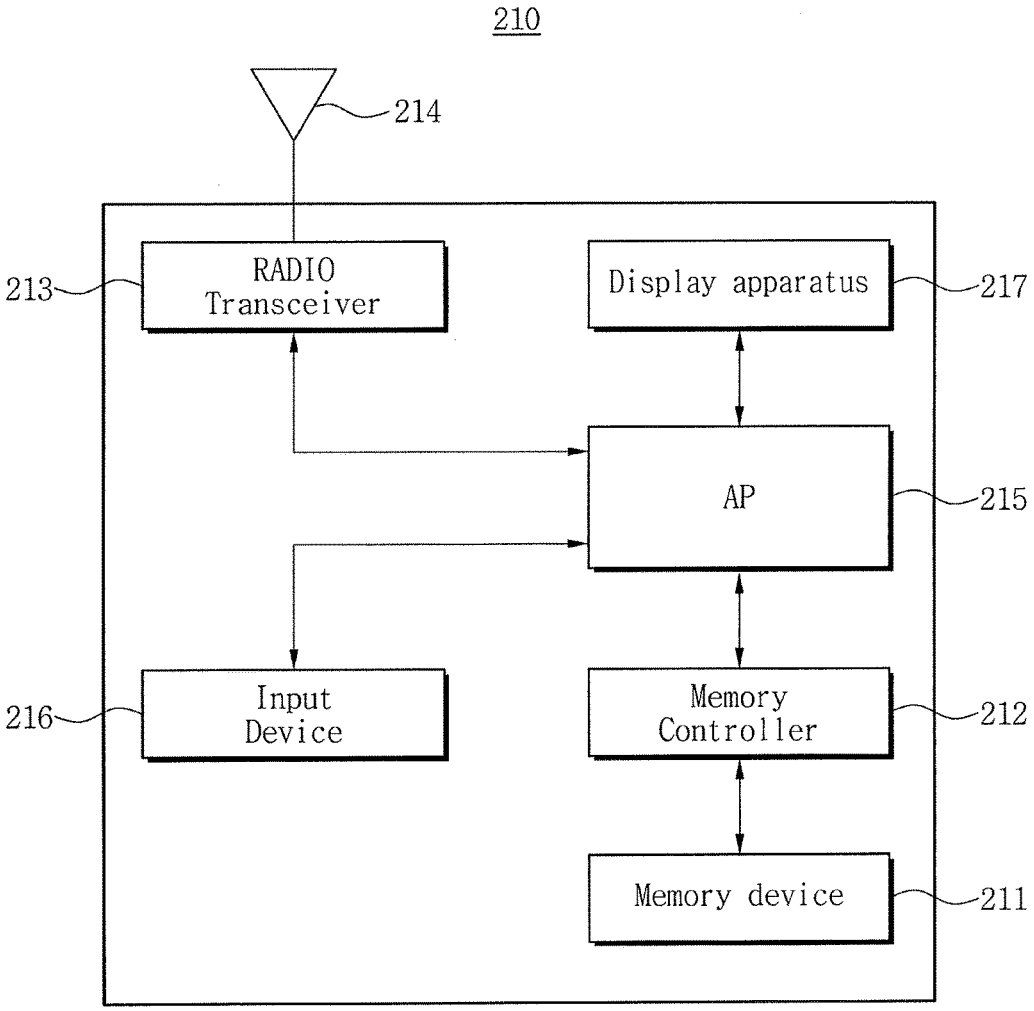
FIG. 11 illustrates an embodiment of a computer system.

FIG. 11 illustrates an embodiment of a computer system 210. Referring to FIG. 11, the computer system 210 includes a memory device 211, a memory controller 212 to control the memory device 211, a radio transceiver 213, an antenna 214, an application processor (AP) 215, an input device 216, and a display apparatus 217.

The radio transceiver 213 transmits and/or receives radio signals through the antenna 214. For example, the radio transceiver 213 may convert a radio signal received through the antenna 214 into a signal which may be processed in the AP 215.

The AP 215 processes a signal output from the radio transceiver 213, and transmits a processed signal to the display apparatus 217. Further, the radio transceiver 213 may convert a signal output from the AP 215 into a radio signal, and output the converted radio signal to an external device through the antenna 214.

The input device 216 may input a control signal for controlling an operation of the AP 215 or data to be processed by the AP 215. The input device 216 may be implemented as a pointing device. e.g., a touch pad, computer mouse, keypad, or keyboard.

According to one embodiment, the memory controller 212 controls operation of the memory device 211 and may be implemented as a part of the AP 215 or in a chip separate from the AP 215. The display apparatus 217 may be, for example, the display apparatus 10 in FIG. 4.

Figure 12:
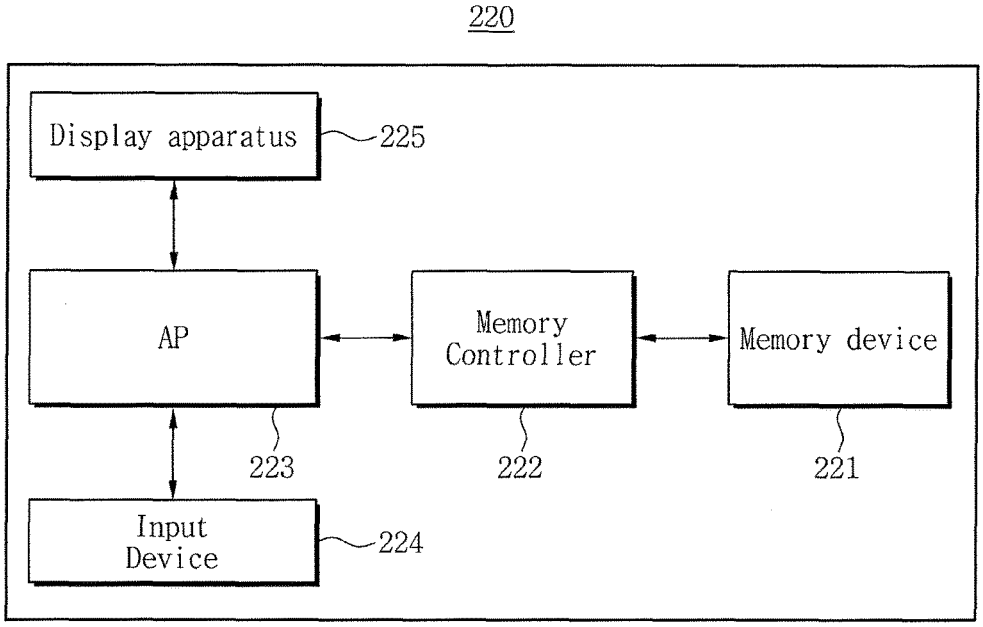
FIG. 12 illustrates another embodiment of a computer system.

FIG. 12 illustrates another embodiment of a computer system 220. Referring to FIG. 12, the computer system 220 may be implemented as a personal computer (PC), a network server, a tablet PC, a net-book, an e-reader, a personal digital assistant (PDA), a portable multimedia player (PMP), a MP3 player, or a MP4 player.

The computer system 220 includes a memory device 221, a memory controller 222 to control a data processing operation of the memory device 221, an AP 223, an input device 224, and a display apparatus 225.

The AP 223 displays data stored in the memory device 221 through the display apparatus 225 based on data input through the input device 224. The input device 224 may be, for example, a pointing device such as a touch pad, computer mouse, keypad, or keyboard. The AP 223 may control overall operations of the computer system 220, and may control operation of the memory controller 222.

According to one embodiment, the memory controller 222 controls operation of the memory device 221 and may be implemented as a part of the AP 223 or in a chip separate from the AP 223. The display apparatus 225 may be, for example, the display apparatus 10 in FIG. 4.

Figure 13:
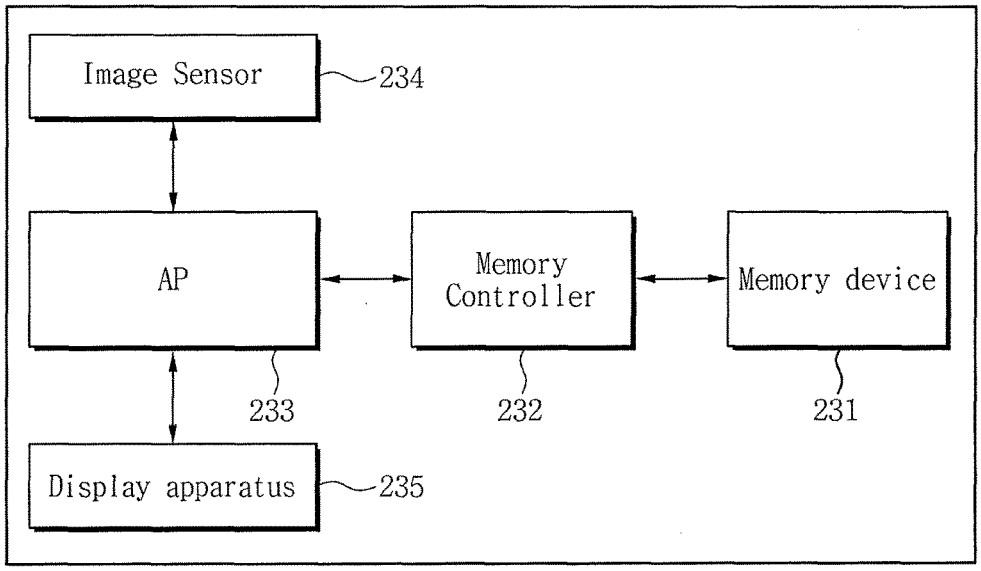
FIG. 13 illustrates another embodiment of a computer system.

FIG. 13 illustrates an embodiment of a computer system 230, which, for example, may include the display apparatus 10 in FIG. 4. Referring to FIG. 13, the computer system 230 may be or include an image processing device, for example, a digital camera, or a mobile phone, a smart phone, or a tablet in which a digital camera is mounted.

The computer system 230 includes a memory device 231, a memory controller 232 controls a data processing operations, for example, a write operation and/or a read operation of the memory device 231. The computer system 230 includes an AP 233, an image sensor 234, and a display apparatus 235.

The image sensor 234 of the computer system 230 converts an optical image to digital signals. The converted digital signals are transmitted to the AP 233 or the memory controller 232. The converted digital signals may be displayed on the display apparatus 235, or may be stored in the memory device 231 through the memory controller 232, according to a control of the AP 233.

Data stored in the memory device 231 is displayed on the display apparatus 235 according to a control of the AP 233 or the memory controller 232. According to one embodiment, the memory controller 232 controls operation of the memory device 231 and may be implemented as a part of the AP 233 or in a chip separate from the AP 233. The display apparatus 235 may be, for example, the display apparatus 10 in FIG. 4.

In accordance with one or more of the aforementioned embodiments, the display driver IC provides a switch in or coupled to an operational amplifier located in a source driver IC and appropriately adjusts whether the switch is turned on or off. Thus, an output voltage characteristic of a data voltage may be improved along with driving speed. The embodiments described herein may be applied to a liquid crystal display device or another type of display device, and specifically the embodiments of the DDI and memory system may be applied to the same.

By way of summation and review, the transmittance of light passing through the liquid crystal layer of an LCD may be adjusted according to an applied image signal, and images are formed as a result. However, the operational speeds of DDIs may need to be increased as the resolution and display area of the LCDs increase.

In accordance with one or more of the aforementioned embodiments, a source driver IC and a display driver IC may improve RC delay, and thus the characteristic of an output signal of the source driver IC may be improved.

In accordance with these or other embodiments, a switch is provided between a feedback terminal and an output node of an operational amplifier in the source driver IC. The switch is appropriately adjusted between on and off states, and thus a pre-emphasis voltage may be applied to the output node. Therefore, a pre-emphasis operation is performed on an output terminal side rather than an input terminal side. As a result, the pre-emphasis operation does not limit the operational speed of the operational amplifier. In addition, because one switch may control the pre-emphasis operation in two-phases, the design and control operation of the source driver IC are simplified.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

The invention claimed is:

1. A display driver integrated circuit (IC), comprising:

an operational amplifier having a first input terminal to receive an input signal, second input terminal to receive a feedback signal, and an output terminal to output an output signal;

a switch connected between the second input terminal of the operational amplifier and the output terminal of the operational amplifier;

a first capacitor connected between the second input terminal of the operational amplifier and the output terminal of the operational amplifier, the first capacitor connected in parallel with the switch, wherein the display driver IC is to provide a pixel voltage which corresponds to the output signal, wherein the pixel voltage to be output during a first predetermined time is different from a data voltage corresponding to the input signal, and wherein the display driver IC is to control a pre-emphasis voltage added to the data voltage based on an on state or off state of the switch.

2. The IC as claimed in claim 1, wherein the display driver IC is to:

apply the pre-emphasis voltage to the output signal during a second predetermined time, and control a slew rate of the output signal.

3. The IC as claimed in claim 1, further comprising:

a serial-to-parallel data converter to convert digital image data in a serial form to a parallel form;

a data latch to latch the digital image data in the parallel form; and a digital-to-analog (DA) converter to convert the latched digital image data to analog image data corresponding to the input signal.

4. The IC as claimed in claim 3, further comprising a second capacitor between the second input terminal of the operational amplifier and a reference voltage.

5. The IC as claimed in claim 4, wherein the pre-emphasis voltage is generated to have a magnitude based on a capacitance distribution ratio of the first and second capacitors.

6. The IC as claimed in claim 1, wherein the pre-emphasis voltage is generated when the switch is in an off state.

7. The IC as claimed in claim 1, wherein, when the pre-emphasis voltage is generated, a slew rate of the output signal is adjusted.

8. The IC as claimed in claim 7, wherein, when the pre-emphasis voltage is applied, an output characteristic of the output signal has a greater slope than an input signal of the operational amplifier.

9. The IC as claimed in claim 8, wherein a point corresponding to a predetermined percentage in a rising range of the output signal is higher than a level of a point corresponding to the predetermined percentage in a rising range of the input signal.

10. The IC as claimed in claim 9, wherein the predetermined percentage is about 67%.

11. A method for controlling a display driver integrated circuit (IC), comprising:

applying a first input voltage to a pixel of an $n^{th}$ line;

applying a second input voltage to a pixel of an $(n+1)^{th}$ line;

generating a pre-emphasis voltage relative to the pixel of the $(n+1)^{th}$ line; and additionally applying the pre-emphasis voltage to the second input voltage of the pixel of the $(n+1)^{th}$ line, wherein applying the pre-emphasis voltage of the pixel of the $(n+1)^{th}$ line is performed in two-phases, wherein the display driver IC includes an operation amplifier and a switch, the switch connected to the operational amplifier to be turned on when the first input voltage and the second input voltage are applied to the pixels of the $n^{th}$ line and the pixel of the $(n+1)^{th}$ line, and wherein generating the pre-emphasis voltage includes turning off the switch connected to the operational amplifier.

12. The method as claimed in claim 11, wherein the switch connected to the operational amplifier is connected to a feedback terminal side of the operational amplifier.

13. The method as claimed in claim 12, further comprising:

when the pre-emphasis voltage is applied, controlling a characteristic of an output voltage of the operational amplifier to have a greater slope than the input second input voltage.

14. A display apparatus, comprising:

a display panel configured to display an image; and a source driver integrated circuit (IC) including:

an operational amplifier having a first input terminal to receive an input signal, a second input terminal to receive a feedback signal, and an output terminal to output an output signal;

a switch connected between the second input terminal of the operational amplifier and the output terminal of the operational amplifier, wherein the source driver IC is to provide a pixel voltage corresponding to the output signal, wherein the pixel voltage is different from a data voltage corresponding to the input signal, wherein the source driver IC is to adjust a slew rate of the output signal relative to the input signal, the slew rate adjusted to reduce a delay of a signal line connected to the display panel, and wherein the source driver IC is to control a pre-emphasis voltage added to the data voltage based on an on state or off state of the switch.

15. The apparatus as claimed in claim 14, wherein the source driver IC is coupled to a connector attached to the display panel.

16. The apparatus as claimed in claim 14, wherein the delay is an RC time constant of the signal line.

17. The apparatus of claim 14, wherein the signal line is a data line.

18. The apparatus as claimed in claim 14, further comprising:

a source driver printed circuit board (PCB) to provide a control signal to the display panel; and a connector attached to the source driver IC between the source driver PCB and the display panel.

* * * * *